US005741372A

United States Patent [19]

Gugel

[11] Patent Number: 5,741,372

[45] Date of Patent: Apr. 21, 1998

[54] METHOD OF PRODUCING OXIDE SURFACE LAYERS ON METALS AND ALLOYS

[76] Inventor: Saveliy M. Gugel, 109-10 Park La. S., #B3, Richmond Hill, N.Y. 11418

[21] Appl. No.: 744,972

[22] Filed: Nov. 7, 1996

[51] Int. Cl.[6] ..... C23C 8/16

[52] U.S. Cl. ..... 148/276; 148/284; 148/277; 148/280; 148/286; 427/360

[58] Field of Search ..... 427/366; 148/276, 148/277, 280, 286, 284

[56] References Cited

U.S. PATENT DOCUMENTS 2,862,842 12/1958 Bernick ..... 148/286
5,413,642 5/1995 Alger ..... 148/239

*Primary Examiner*—Sam Silverberg
*Attorney, Agent, or Firm*—Ilya Zborovsky

[57] ABSTRACT

A method of producing oxide surface layers on compact and sintered metals and alloys has the steps of delivering a metal or alloy into a working chamber preheated to temperature from 200° C. to temperature below its melting point so that the metal or alloy is heated in the working chamber in waterless atmosphere to a temperature from 100° C. to below a melting point of the metal or alloy in waterless atmosphere at atmospheric, reduced or increased pressure, and then introducing into the working chamber a water solution of substances which contain alloying elements so that water steam and volatile oxides of the alloying elements are formed directly into the working chamber interact with a surface of the metal or alloy to produce an alloyed surface layer of the metal or alloy.

10 Claims, No Drawings

METHOD OF PRODUCING OXIDE SURFACE LAYERS ON METALS AND ALLOYS

BACKGROUND OF THE INVENTION

The present invention relates to a method of producing oxide surface layers on metals and alloys.

More particularly, it relates to a method which involves steam thermochemical treatment for the formation of oxide surface layers on compact and cintered metals, alloys and superalloys, in order to increase anti-corrosive, antierosive, anticavitative, antifrictive, antiwear, dielectric properties, adhesion and quality of overlying enamel and paint coatings.

Today metals, alloys, and superalloys are main constructive materials widely used in different fields of machine building. The service conditions of machine parts are very harsh under influence of high temperature, load, pressure or vacuum, velocity and acceleration, chemical and physical reactions and interactions with the environment. Materials resistance against corrosion, erosion, cavitation, friction, wear, and other negative factors is important for increasing the reliability and longevity for both civil and military products. For some of metal applications it is necessary to provide a better dielectric, adhesive and aestetic surface quality. It has been a continuing effort in these fields to find ways to improve these material properties by special treatment.

The method of steam thermochemical treatment for the formation of protective oxide surface layers both on compact and sintered metals, alloys, and superalloys is well known in the art. This method is relatively simple, comparatively inexpensive, and have no harmful influence on environment. Typically, this treatment method is used as a means to protect the metal from harsh service conditions, and as a replacement substitute process of electroplating and chemical surfacing are widespread in industry. Notwithstanding its success in service,these processes have a lot of deficiencies in production such as technical, technological, economical problems, some problems connected with environmental protection and much more. Besides of that these processes changes the size of treatment parts and are a cause of hydrogen saturation which imparts the mechanical properties of the metals being treated. But they have often produced the protective coatings with properties which are better than some properties of the oxide surface layers produced by plane steam oxidation. Therefore, substitution of harmful and expensive protective metal treatment by steam oxidizing can be done by improving oxide surface layer properties which do not sufficient for some service conditions of compact and sintered metal, alloy, and superalloy parts. The properties of metal surface depend on chemical composition and structure which have to be changed in desired direction.

It is known that plain steam oxidizing of iron base alloys to form a coating of $Fe_3O_4$ on its surfaces. A variety of specific ideas have been used for improving this process and enhancing the protective properties of surface layers.

Methods for forming protective coatings with better properties for iron base sintered and compact alloys have been disclosed in U.S. Pat. No. 4,141,759; U.S. Pat. No. 4,153,480; U.S. Pat. No. 4,297,150, U.S. Pat. No. 4,799,970, U.S. Pat. No. 5,199,998; U.S. Pat. No. 5,288,345; U.S. Pat. No. 5,413,642. U.S. Pat. No. 4,141,759 disclosed a method for mazaging steels containing the components Ni, Co, Mo, and Ti by subjecting the surface to superheated steam or mixture of steam, $N_2$, $O_2$, or air in ratios 4:1 or 5:1 for a period of at least one to several hours under the treatment temperature between 450° and 520° C. This temperature is reached and maintained under turbulent steam flow or the flow should have a Reynolds number greater than 900. The superheated steam raises the steel temperature generally in about 1 to 5 hours. Before subjecting the steel to a superheated steam, a clean steel surface is initially heated to at least 200° C. in air or oxygen atmosphere in the absence of superheated steam within 20 to 60 min and this heating removes organic impurities. Should steel be contaminated with a thin oxide layer then the steel is heated to over 400° C. in an $N_2$ and $H_2$ (4–5):1 or $N_2$ and $NH_3$ (4–5): 1. It is explained that alloying elements in steels are not so important for the process itself. After the steam treating, the steel is cooled for several hours into a surface to about 100° C. by subjecting it to a stream of air, or nitrogen for preventing further oxidation of the oxide layer. The entire process can take place in an accurately regulatable fluidized bed furnace.

Presence of Ni, Co, Mo, and Ti in these steels permits formation of mixed oxide layers on its surfaces which consist of mixed and pure spinels of the types Fe ($Fe_2O_4$), Ni ($Fe_2O_4$), Ni($Co_2O_4$), and $FeMoO_4$. U.S. Pat. No. 4,153,480 is a further improvement of U.S. Pat. No. 4,141,759. It has been mentioned that formation of undesireable thin oxide layers before the steam treatment in the method described in the previous patent could not be prevented in all cases. In order to remove these layers in simple and harmless manner the steel can initially be heated in a gaseous formic acid or mixture of formic acid and such carier gas as argon or nitrogen atmosphere to a raised temperature from 400° up to 480° C. from 20 to 60 minutes.

During this initial formic acid treatment the steel is not subjected to steam treatment. The formic acid preferably is mixed with an inert gas, such as nitrogen or argon, which serves as a carier gas in range 1 to 4 or 5 volume part. Then, the steel is maintained at the temperature of about 450° C. to 520° C. by the superheated steam for a period from about 1 to 5 hours. During the treatment the superheated steam flow condition should be as turbulent as possible. Generally the Reynolds number of flow must be at least 900 to prevent hydrogen embrittlement. After treatment steel is cooled for several hours to a temperature above 100° C. in a gas stream with regulatable temperature. Heating and cooling are effected in a regulatable fluidized bed furnace. As a result, the produced oxide layer comprises mixed oxides which are mentioned in U.S. Pat. No. 4,141,759. U.S. Pat No. 4,297,150 discloses a process for forming protective metal oxide films on metal or alloy substrate surfaces susceptible to coking, corrosion or catalytic activity which comprises surfaces preoxidizing at an elevated temperature in oxidizing atmosphere such as air, $CO_2$, or steam and then depositing on it a film of a high temperature stable, non-volatile oxide of a metal selected from Ca, Mg, Al, Ca, Ti, Zr, Hf, Ta, Nb, or Cr by vapor phase thermal decomposition of a volatile compound, of the metal which has at least one metal-oxygen bond. These metal compounds are selected from metal alkoxides, metal-d-deketonates, and metal carboxylates. Specific examples of the volatile compounds are the ethoxids, normal propoxides, the isopropoxides, the normal and tertiary-butoxides and the acetylacetonates. Examples of such compounds are aluminium and titanium isoproxides, titanium-n-butoxide, zirconium-n-propoxide, aluminium and chromium acetylacetonate, tantalum and niobium ethoxides. If necessary the volatile metal compounds either liquids or solids at ambient temperature may be dissolved in a compatible solvent or diluted with a compatible diluent to reduce viscosity. Examples of such solvents or diluents are toluene, methanol, isopropanol, and tertriary butanol. The solution or diluted liquid then vaporized and mixed with the carrier gas, prior to thermal decomposition. Nitrogen, helium,argon, carbon dioxide, air or steam may be used as carier gases for the metal compound. Such active medium has to have no more than 10 ppm of moisture because it can loose its deposition efficiency, produce irregular deposition rates and uneven and rough deposits can be obtained. For these purposes it is necessary that reactant and carrier gases will be pre-dried before feeding into working zone. The amount of the volatile compound will depend on the nature of the substrate and the thickness of film required. The concentration of the volatile metal compound in carrier gas is less than 10% v/v, preferably between 0.01 and 1.5% v/v. The process temprature is between 200° and 1200° C. with use of atmospheric, reduced or increased pressures. The process works for protecting surfaces of metals or alloys comprising one or more of copper, aluminium, titanium, zirconium, tantalium, chromium, cobalt, nickel and iron, wherein the alloy is selected from brasses, cupronickels; mild, carbon, low alloy, stainless, high alloy, superalloy steels and zircalloys. U.S. Pat. No. 4,799,970 discloses a three-step method of ferrous sintered parts treatment. In the first step which is the plain steam treatment, the porous sintered parts are subjected to a steam atmosphere heated to a temperature within the range of about 400° to 600° C. for several hours to form dense oxide films mainly composed of $Fe_3O_4$. Then, on the surface of these parts special liquid coating consisting of Al or Zn, hexavalent chromium, reducing and surface acting agent is applied. These parts are dried at a temperature of 250° to 400° C. to form a coating film which then is impregnated by water glass or resin for sealing of surface pores.

U.S. Pat. No. 5,199,998 discloses a method of stabilizing against oxidation and corrosion of acicular, ferromagnetic metal powders essentially consisting of iron by two-stage reaction of this powder with an oxygen-containing inert gas with the proviso that the oxygen content is not more than 2° by volume in the first stage, which duration is from 80 to 240 min wherein an oxygen/inert gas mixture having a water vapor content of from 70 to 95% relative humidity and an oxygen content of from 10 to 20% by volume is used in the second stage from 1 to 24 hours. It is essential for this processing method that the two stages are carried out directly one after other. After processing the metal particles are surrounded by a particularly pure, uniform and dense oxide coating.

U.S. Pat. No. 5,288,345 discloses a method for treatment sintered parts having protrusions and depressions along its surfaces which comprises exposing at least a portion of sintering alloy containing Al to temperature from about 800° to about 1300° C. or about 1000° to 1200° C. under an atmosphere which contains only water vapor (plain steam oxidation) in amount corresponding to a dew point within the range of about 30° to about 60° or 40° C., or the vapor and hydrogen, or vapor and oxygen, or vapor and mixture of oxygen and nitrogen. Time of treatment is equal or less than 5 or 10 hours; equal or longer than 30 min or 1 hour. Sintured alloy to be treated must contain Al and have a melting point equal to or higher than a surface treatment temperature. Other element in the sintured alloy are not particularly restricted, and at least one element is selected from the group consisted of Fe, Cr, B, Si, La, Ce, Cu, Sn, Y, Ti, Co, Ni, Ca, alkaline earth metals, lanthanides, Hf, and Zr.

U.S. Pat. No. 5,413,642 discloses the processing for forming a barier that is resistant to permeation by hydrogen isotopes, wear, corrosion, and which inhibits erosion by reducing on the surface of special alloys are contained Ni, Co, Cr, Ti, and Al, less stable such metals oxides of nickel, chromium and iron to oxides such metals with higher stability as Ti and Al which are contained in these alloys in relatively low concentratic. For these purposes the alloy is maintained at the sufficient elevated temperature preferably between 1000° and 2000° F. and for a sufficient duration in the presence of the working fiud contained either the water vapor only in vacuum, or mixture of hydrogen or inert gas with water vapor in amount of from 1 to 500 parts per million (ppm) or $CO/CO_2$ oxygen bearing gas mixture; or liquid metal other than lithium which carries oxygen, or liquid lithium which reduced both the less and higher stable oxides. $CO—CO_2$ reducing/oxidizing atmosphere, hydrogen and water vapor reduced the less stable oxides and the oxygen oxidized the such specific reaction elements as Ti and Al. The process of heating the alloy is continued as additional specific reactive element atoms diffuse from the alloy to the surface and are oxidized. The liquid metals which have contained oxygen, or nitrogen, or carbon react with the least specific elements to form oxides, nitrides, or carbides.

A different method for forming a specific reactive element nitride or carbide barrier layer on a surface is provided too. In such embodiment after heating in reducing atmosphere the source of this atmosphere is valved off and simultaneously a flow of either nitride forming gas consisting of hydrogen, which contains from 1 to 500 ppm of nitrogen, ammonia or other nitrogen containing gas, or carbide forming gas consisting of hydrogen, which contains methane or other hydrocarbons in the same quantities, is flowed over the specific reactive elements on the surface to form its nitrides or carbides. Specific elements can be implemented or diffused to alloy surface prior to being treated with any of atmospheres described above. The specific reactive elements include Al, Ti, Zr, Ta, Nb, Si, Be, V, Mn, U, Mg, Th, Ca, Ba, and rare earth elements such as Hf, Y, etc., and combinations and alloys thereof. These elements are generally minor constituents of a bulk volume. The process can be used for Ti base alloys too.

These processes have been used for special materials, definite application fields, and specific service conditions, and they are not devoid of some substantial disadvantages.

SUMMARY OF THE INVENTION

Accordingly, it is an object of present invention to provide a method of producing oxide surface layers on metals and alloys, which avoid the disadvantages of the prior art.

In keeping with these objects and with others which will become apparent hereinafter, one feature of the persent invention resides, briefly stated, in a method in accordance with which a metal or alloy is accomodated in a heating device in which the metal and alloy is maintained at atmospheric, reduced or, increased pressure in waterless atmosphere of $N_2$, air, $CO_2$, $NH_3$ or mixtures of them and then is heated to a temperature above 100° C. but below its melting temperature and then a water solution of compounds containing alloying elements is introduced into the heating device so that steam is produced directly into the furnace working chamber and the compounds disintegrate to form oxides of the alloyed elements, the steam oxidizies surface of the metal or alloy and in addition the oxides of the alloyed elements interact with the surface, additionally oxidized the metal or alloy, and upon contact with the surface formed the alloyed elements which alloy the surface of the metal or alloy.

When the method is performed in accordance with the present invention, anticorosive, antiorosive, anticavitative, antiwear, dielectric, enamel and painting suitable, and colored aesthetic alloyeed oxide surface layers having better properties than the known art are produced on compact and sintered metals, alloys and superalloys. There are no limitation for size, shape, or form of the parts.

The method in accordance with the present invention is harmless, simplier, and less expensive in equipment, maintenance, labor, energy, space, materials, and environmental protection than known methods.

In the inventive method the metal, alloy, and superalloy parts are delivered into a suitable working chamber preheated to temperature from 200° C. to below the melting point of these metals, alloys and superalloys and then these parts are heated at atmospheric, reduced, or increased pressure in waterless atmosphere at $N_2$ air, $CO_2$, $NH_3$, or mixtures of them to temperature 100° C. and higher to prevent water dew arising on their surfaces. Then, during continuous heating, of these parts at atmospheric, reduced, or increased pressure from 100° C. to the optimum processing temperature which is from 200° C. to beneath the melting point of these metal, alloy, and superalloy, the parts surfaces are subjected, at the elevated temprature and subsequent soaking, for a period of at least 30 min and higher for sufficient duration to obtain the desired thickness and chemical composition of oxide layer, to the suitable active vapor atmosphere containing a pure water steam and volatile alloying chemical compounds, radicals, and elements formed by disocciation of suitable liquid medium which is fed directly in the furnace working chamber. These volatile particles are alloying and oxidizing the part surface layer simultaneously with steam which increase the volatilines of these particles. Liquid media are solutions of water soluble chemical compounds of desired alloying elements in pure, distilled, deionized, or demineralized water which can be heated and mixed for increasing of their solubility. During feeding of these liquid media into the working chamber, the supply of $NH_3$ can be continued. The water soluble compounds are inorganic compounds which contained elements from such groups of Mendeleevin Periodic Table as la (Li is prefered) II a (Be is prefered), III a (B is prefered), IV a (Ge is prefered), Va (N is prefered), III b (Y is prefered), IV b (Ti is prefered),Vb (V is prefered) VI b (Cr, Mo, and W are prefered). Such chemical compounds are ammonium salts, acetates, benzoates, citrites, formates, hydroxides, magnanates and parmanganates, metalic acid and oxides, nitrates and nitrides, molybdates, titanates, tangstates, vanadates, etc. which are suluble in water and further decompose in furnace working chamber when heated to the processing temperature.

During this processing which creates an alloyed oxide surface layer from surrounding active atmosphere some elements from alloy and superalloy core simultaneously diffuse to surface and create the more complex compounds into the surface layer. Choosing alloy and superalloy chemical composition and sufficient soaking time for diffusion of such elements to the surface provide for additional improvements of chemical composition, structure and properties of diffusion oxide surface layer obtained by treatment in active atmosphere which is used in the working chamber of furnace. After treatment at high processing temperature the parts are cooled to the ambient temperature with different velocity on the air or in the cooling media, whose chemical compositions and physical conditions depend on desired part surface and core properties. Cooling media are gaseous, liquid, or solid matter. Cooling gases and active vapor atmosphere mentioned above can be used either in working chamber of furnace or in a special additional cooling chamber with measured and controlled cooling temperature velocity. Liquids are organic and inorganic chemical compounds and their water or oil solutions of substances used for controlling of quenching velocity (quenchants), for improving the surface protective properties in service conditions (inhibitors, water-repellents, surface active agents, absorbents, lubricants, etc) and binder, bonding, detergent, or coloring agents, etc. for improving of surface technological properties.

Solid cooling media are powdered or granulated matter which can be neutral or active for oxide surface layer in further cooling step. For these purposes sand, oxides, carbides, nitrides, borides and other chemical compositions are used, which can improve the surface properties during cooling from high processing to ambient temperature. These substances are placed in special fixed or vibrating cooling chamber which has devices for measurement and control of temperature and velocity of cooling.

The method of the present invention forms alloyed oxide surface layers both on compact and sintered metals, alloys and superalloys. It also forms alloyed diffusion surface layers which are resistant to corrosion, erosion, cavitation, and wear. It also forms dielectric surface layers. The inventive method, forms alloyed oxide surface layers which are suitable to enameling and painting. It also forms oxide surface layers on the porous powdered metallurgy parts and simultaneously sealed its surface pores.

The method also forms aestetic surface layers which have different colours. It also forms oxide surface layers without hydrogen embrttlement and resistant to permeation by hydrogen. The active atmosphere is created directly in the working chamber from water solutions that is why there is no necessity to use special equipment for steam generation. The processing method is harmless, simple, inexpensive and suitable to various type of production. For the metal powder products, in powder metallurgy, this treatment can be carrying out in the cooling chamber of sintering furnaces directly after sintering. Oxidizing can be carried out simultaneously with heat treatment. The dew point of oxidizing atmosphere can be used for manual or automatic control of water solution feeding into the furnace working chamber for obtaining the desired quality of oxide surface layer. The method can increase the amount of alloying element in feeding water solutions by water heating and stirring. It can use lower temperature and time of processing that in plain stream oxidizing. The method can produce more complicated and more useful alloying oxide surface layers on the alloy and superalloy by using both alloying elements which are contained in the furnace active atmosphere and core of these alloys and superalloy. The method has additional possibilities of oxide surface layer chemical composition, structure, and properties improvement by cooling with different velocity in a coiling media whose chemical compositoin and physical conditions depend on the desired surface and core properties of parts to be treated.

DESCRIPTION OF THE PREFERRED EMBODIMENTS

Metals and alloys treated in accordance with the process of the present invention are preferably compact and sintered iron and iron base alloys, but other compact and sintered metals and alloys can also be treated. The particular metals and alloys are not so important for the process itself; the determining factors are the chemical composition and application. An example of another metals and alloys that can be treated in the process of the present invention are the Mn, Co, Ni, Cu, Cr, Al, and Mg base alloys and superalloys.

The metals, alloys, and superalloys which are treated in accordance with the present invention can be treated in their as-received, cleaned form from their manufacturer and before they have been subjected to corrosive media. It can be metals, alloys and superalloys which have surfaces that are contaminated with oils, greases, or other substances arising from the manufacturing process. It also can be metals, alloys, and superalloys that are initially contaminated with oxide layer which can be converted in desired directions.

In the practice of the present invention the metals, alloys, and superalloys are delivered into a preheated (to temperature from 200° C. to below of melting point of these metals, alloys, and superalloys) working chamber. They are heated to 100° C. and higher at atmospheric, reduced, or increased pressure in waterless atmosphere of $N_2$, air, $CO_2$, $NH_3$, or mixtures of them to prevent water dew arising on their surfaces.

After reaching the desired preheating temperature the parts surfaces are subjected during continuous heating at the elevated temperature and subsequent soaking time at the optimal processing temperature, atmospheric, reduced or increased pressure to the active oxidizing atmosphere containing pure steam and volatile oxides formed directly in the working chamber from suitable liquid media. The soaking time is 30 min and higher to sufficient duration for obtaining the desired thickness and chemical composition of oxide layer. Active media are solutions of water soluable chemical compositions of suitable chemical compounds of desired alloying elements in pure distilled, deionized, or demineralized water, which can be heated and mixed for increasing of their solubility. During feeding these active media into the working chamber the supply of such gases as $CO_2$ and $NH_3$ can be continued. The water soluble compounds are inorganic compounds containing elements from such groups of Mendeleevin Periodic Table as la (Li is profeted), II a (Be is prefered), Ill a (B is profered), IV a (Ge is profered), V a (N is prefered), III b (Y is prefered), IV b (Ti is prefered), Vb (V is prefered) VI b (Cr, Mo, and W are prefered). Such chemical compounds are ammonium salts, acetates, benzoates, citrates, formates, hydrohides, manganates and parmanganates, metalic acids, nitrates, and nitrites, molybdates, titanates, tangstates, vanadates, oxides, etc. which are soluble in water and further decomposed in furnace working chamber when heated to the processing temperature. The metal, alloy, and superalloy are heated in the active atmosphere from desired preheat temperature, for example 100° C. and more to the optimal processing temperature which depend on metal, alloy, and supperalloy nature and desired surface properties and can be from 200% to below the melting point of corresponding material to be treated.

Upon reaching the optimal controlled processing temperature, which depend on chemical composition and application of definite metal, alloy, and superalloy, i.e. necessary protection or technological properties of surface layers, the metal parts are soaked at this temperature in this active atmosphere. The soaking time is from 30 min or more, which depend on desired oxide surface layer thickness and chemical composition. Active atmosphere in the working chamber have to be mixed during all time of treatment including preheating.

The regulation of treatment efficiency of active steam atmosphere is done in two ways. The first preliminary step is changing the amount of chemical compounds in active water medium to limit their solubility at the highest possible temperature which changes the amount of volatile oxides. The second step is changing the quantity of active medium fed to the working chamber which depend on processing temperature, chamber volume, chemical composition, surface and weight of parts to be treated. The optimal quantity of active medium can be connected with active atmosphere dew point or relative humidity. That is why they can be used for control of treatment regims by measuring dew point and subsequently manually or automatically changing the amount of water solution fed into the working chamber.

During this processing some elements from alloy and superalloy core diffuse to surface and create the complex compounds into the surface layer. Choosing alloy and superalloy chemical composition and sufficient soaking time for diffusion of such elements to surface provide additional improvemments of chemical composition, structure and properties of diffusion oxide surface layers during treatment in active atmosphere in the working chamber of furnace.

After treatment the metal, alloy, and superalloy at high processing temperature the parts are cooled to the ambient temperature with different velocity on the air or in cooling media which chemical composition and physical conditions depending on desired parts surface and core properties. Cooling media are gaseous, liquids, or solid matter. Cooling gases are gases and active vapor atmospheres are mentioned above, which can be used either in working chamber of furnace or in special additional cooling chamber with measured and controlled cooling temperature and velocity.

Liquids are organic and inorganic chemical compounds and their water or oil solutions are used for controlling of quenching velocity (quenchants), for improving of surface protective properties in service conditions (inhibitors, water repellants, surface active agents, absorvents, saturants, libricants, etc.), and binder, bonding, detergent, or coloring agents, etc. for improving of sumace technological properties.

Solid cooling media are powdered or granulated matter which can be neutral or active for oxide surface layer in further cooling step. For these purposeces are used sand, oxides, carbides, nitrides, borides, and other chemical compounds which can improve the surface properties during parts cooling from high processing temperature to ambient temperature. These substances are placed in special fixed or vibrating cooling chamber provided with devices for measurement and control of temperature and velocity of cooling.

The present invention is disclosed in more details but it shall not be limited to the following examples which are given by way of illustration of further explain the principles of invention. These examples are merely illustrative and do not limit the scope and underlying principles of the invention in any way. All percentages referred to herein are by weight unless otherwise indicated.

EXAMPLE 1

Specimens of heat resistant steel (carbon 0.12, chromium 1.0 molybdenum 0.25, vanadium 0.15), were oxidized in a shaft electric furnace. The oxidizing atmosphere was obtained from an aquatic solution of ammonium molybdate which concentration was varied from 0 to 1.5% fed directly to the furnace retort. Evaporation in the reaction zone led to formation of an atmosphere consisting of water vapor, ammonia, and molibdic oxide.

$$(NH_4)_6Mo_7O_{24}.4H_2O=6NH_3+7H_2O+7/MoO_3$$

The specimens were placed in the furnace at 200° C. After the retort had been made airtight and heated to 300° C., further heating to the working temperature (500° and 600° C.) was performed at the rate of 150–200° C. in hour, during which time the solution was introduced into the retort. When the working temperature was attained the furnace was kept at it 30 min, then switched off. The feed of the solution during cooling was continued to 400° C., After cooling to 300° C. the specimens were extracted from the retort. In all expirements the feed rate of the solution was 0.35–0.40 liters/h.

The protective capacity of oxide films on metals, alloys, and superalloys is determined by their phase composition, thickness, and porosity.

It used a DRON-0.5 difractometer ($Fe_{kd}$-radiation) for x-ray phase analysis of the specimens suraface.

The surface layer of specimens oxidized in atmosphere is obtained from pure water or water solution of aminomium molibdate which concentration was below 1% consisted of the oxides $Fe_3O_4$ and $\alpha$-$Fe_2O_3$ mainly. At a molybdate concentration of 1% or more the surface layer of specimens consisted only oxide $Fe_3O_4$ and two phases X and Y, which presumably are complex oxides of iron and molybdenum; their interplanar distances and relative intensities of the reflection are given in Table 1.

TABLE 1

Interplaner Distances ($d_{hkl}$) and Relative Intensities (I) of the X and Y Iron-Molybdenum Phases

| X phase | | Y phase | |
|---|---|---|---|
| I | $d_{hkl}$ | I | $d_{hkl}$ |
| 2 | 3.92 | 1 | 2.99 |
| 3 | 2.22 | 3 | 2.85 |
| 4 | 3.57 | 4 | 1.725 |
| 10 | 3.42 | 10 | 2.44 |

The content of the X and Y phases increased with oxidation temperature; the Y phase usually predominated. The influence of molybdate in water solution on the oxide film thickness was estimated from the ratio of the increase in mass of the specimen to its surface area. In each expirement it placed five specimens in the furnace and the expirements were duplicated.

It is seen from Table 2 that at a molybdate concentration in water solution up to 1% the increase in mass of the specimens remains practically the same as during oxidation in pure water vapor. At concentration of 1.5% the thickness of the film obtained at 500° and 600° C. increases by 30 and 24% respectively.

TABLE 2

Increase in specimens mass after oxidation mg/cm$^2$.

| Temperature | Molybdate concentration, % | | | |
|---|---|---|---|---|
| °C. of oxidation | 0 | 0.5 | 1.0 | 1.5 |
| 500 | 0.39 | 0.40 | 0.41 | 0.53 |
| 600 | 1.05 | 1.06 | 1.10 | 1.30 |

To determine the porosity of the oxide films, filter paper was wetted in an agueous solution of the following composition (g/liter); potassium ferrocyanid 10, sodium chloride 15, gelatin 5; it was placed on the specimen surface and kept their until dry, after which it counted the number of blue points per square centimeter of surface by special device. Oxidation with use of 1.5% or more molybdate in water solution gives practically nonporous coatings versus 8–10 pores/cm$^2$ and more with use pure water.

Thus proposed oxidation method enhances the protective properties of the oxide coatings by formation of alloying Mo—Fe oxides, decreasing the surface porosity and increasing surface layer thickness.

EXAMPLE 2

Specimens of ordinary carbon steel (carbon 0.35%), ferritic chromium stainless steel (carbon 0.20%, chromium 13%), and gray cast iron were oxidized in laboratory electric shaft furnace. An oxidizing atmosphere was obtained from an agueous solution of ammonium molybdate (1.5%), which was supplied directly to the furnace working space at 0.03–0.035 liters/h during treatment. The specimens were loaded into the furnace at the appropriate oxidation temperature for each material (450° C. for carbon steel, 50° C. for cast iron and 750° C. for stainless steel) and kept for 1 hour.

The supply of solution was then stopped, and the specimens were removed from the furnace, cooled in air, and microsections of the oxidized specimens were investigated. The chemical composition of the coatings was determined on an MS-46 microanalyzer and CAMEBAX scanning electron microscope-microanalyzer (made by CAMECA, France). It determined the principal elements-molybdenum and iron-and made spot checks on chromium, silicon, and manganese acording to the material of the specimen. The electron probe was focused to a spot which have 1 mm in diamater.

The recording regime was chosen so as to give optimal resolving power. In investigations the working accelerating voltage was 20 kV, and the electron-probe current ranged 300 pA to 0.5 μA according to the concentration of the given element in the investigated region. When the concentration of the element was a maximum, the intensity of the x-rays was 5000 pulses/sec. The relative error in the quantitive estimation of the contents of the elements did not exceed 3%.

In all the specimens the presence of molybdenum was detected right through the thickness of the oxide layer; this thickness was 30 μm for carbon steel, 16 μm for gray cast iron, and 10 μm for stainless steel. Its concentration was a maximum on the 4 μm distance from the surfaces of specimen (by influence of air in the time of cooling)—from 28% for carbon steel to 38–42% for cast iron and stainless steel. The molbdenum concentration decreases toward to inner boundary of the surface layer. In the scanning electron microscope images we see that the molybdenum containing layer is uniformly distrubted over the surfaces of specimens. The bulk concentration of iron in the coatings is minimal at the points of maximal concentration of molybdenum and is 50% in carbon steel and about 30% in gray cast iron and stainless steel. The other element also occur in the oxide coatings. On carbon steel and gray cast iron the influence of silicon is clearly marked; its maximum concentration is observed in the surface layers at a depth of 12–14 μm and in 2 times or more is greater than the bulk content in the alloys. In the stainless steel we observed inrichment of the inner layer of the coating with chromium.

The accumulation of alloying and impurity elements in the diffusion oxide surface layers is partly explained by the higher rate of iron atoms diffusion in solid phasis of iron-oxygen system. However, in oxidation in the given conditions it must be promoted by counterdiffusion of molybdenum from the external medium. Thus, these investigations have yielded data which enable us to state with some confidence that immpregnation of the surface with molybdenum on heating to 450°–750° C. in the vapor of an agueous solution of ammonium molybdate is the diffusion type. The depth of penetration corresponds to the thickness of the oxide coating which depend on material have been treated, temperature and time of processing.

EXAMPLE 3

Experience with operation of power plant valves shows that their service life is to a considerable extent limited by low corrosion resistance of the rods (stems). Their wear is due to electrochemical corrosion at the point of contact of the rod with the gland packing. To reveal the nature and mechanism of damage to rods investigations were carried out which were based on the potentiostatic method of corrosion processes study. For experiments it was selected ferritic stainless steel (carbon 0.30%, chromium 13%) stems of valves, Din=10 mm. The investigations were carried out in a electrochemical cell with employment of PEB potentiostat, a logarithmic calculator and an LV-1 cathodic voltmeter. Platinum was used as the auxiliary electrode, and a saturated calomel electrode, having a steady potential of 0.25 V, was used as the reference electrode. As electrolite it used a 1N solution of sodium chloride.

The investigation has shown that corrosion damage of stems is result of electrochemical corrosion due to formation of galvanic couple "gland packing-stem". Therefore the use of any metal coatings, or any metals for stem production cannot produce favorable results because all metals have in comparison with the graphite of the packing a more negative electrode potential. Corrosion in these cases will take place more intensively the greater the difference in electrode potential of the stem material and the material of the gland packing. There is only one way for corrosion annihilation or effective reduction. This way is production of strong coating with dielectric properties on the stem surface in the area of the gland contact.

The oxidizing of steel stems (carbon 0.30, chromium 13%) was carried out in the vapor of 1.5% agueous solution of ammonium molybdate at temperature of 650° and 740° C. in the shaft electric furnace is mentioned above. The duration of soaking at these temperatures was 60 min. After treatment the stems were of even dark-gray colour. No variation in the geometrical sizes was noted, the smoothness of the surface corresponded to the tenth class of surface roughness.

The thickness of the alloying diffusive coating was 10–12 μm, microhardness amounted to 800–900 HV. The protective properties were investigated also by the potentiostatic method and can be seen in the Table 3.

TABLE 3

The protective properties of the valve steams Din = 10 mm.

| No. | Type of Treatment | Test Time | Results |
|---|---|---|---|
| 1 | Without treatment | 30 min | Great number of pits with depth of 0.10–0.12 mm |
| 2 | Nickel plated coat thickness 0.01–0.02 mm | 30 min | Great number of pits with depth of 0.08–0.10 mm |
| 3 | Oxidizing in 1.5% aqueos soiution of the | 30 min | No damages |

TABLE 3-continued

The protective properties of the valve steams Din = 10 mm.

| No. | Type of Treatment | Test Time | Results |
|---|---|---|---|
| 4 | ammonium molybdate, at 650–740° C. | 60 min | No damages |
| 5 | and soaking time 60 min | 90 min | No damages |
| 6 | | 120 min | No damages |

In expirements No. 3–no current was recorded, which is due to dielectric interlayer between the metal of the stem and the material of the gland packing. Thus proposed oxidation method is a fundamentally new approach for increasing of contacting metal parts electrochemical corrosion resistance by providing a strong dielectric alloyed oxide film on the surface of the one part of such metal pairs.

EXAMPLE 4

The further increase of the powder metallurgy product usage demand on their surface protective properties improving. The treatment of iron-base powder metallurgy parts, which had different composition was carried out in the shaft electric furnace. The oxidizing atmosphere in furnace retort was obtained from the aqueous solution of the ammonium molbydate fed directly to the working space. This solution was prepared by solution of 20 gr of ammonium molybdate per 1 liter of distilled water. This solution is not toxic, it time of storage is not limited. The parts were put into preheated to the working temperature retort and after treatment into waterless atmosphere to 200° C. and more subjected to the active atmosphere which is product of agueous solution dissosiation. The results have been represented in the Table 4.

TABLE 4

The results of powder metallurgy parts oxidizing

| | Parts composition %* | | | | Treatment parameters | | Layer thickness μm | |
|---|---|---|---|---|---|---|---|---|
| No. | Graphite | S | Cu | Al | T °C. | time, hours | on surface | into pores |
| 1 | 3.0 | | | | 600 | 2.0 | 40 | 20 |
| 2 | 5.0 | | | | 600 | 2.0 | 40 | 20 |
| 3 | 3.0 | 0.8 | | | 600 | 2.0 | 40 | 20 |
| 4 | 5.0 | 0.8 | | | 600 | 2.0 | 40 | 20 |
| 5 | 1.0 | 0.4 | 1.5 | | 600 | 2.0 | 40 | 20 |
| 6 | 1.0 | 1.0 | 1.0 | | 550 | 1.0 | 35 | 15 |
| 7 | 1.0 | 1.0 | 1.0 | | 600 | 1.0 | 35 | 18 |
| 8 | 1.0 | 1.0 | 1.0 | | 650 | 0.75 | 30 | 15 |
| 9 | 1.0 | 1.0 | 1.0 | | 650 | 0.5 | 25 | 10 |
| 10 | | | 2.0 | | 650 | 1.0 | 25 | 15 |
| 11 | 3.0 | 0.8 | | | 650 | 1.5 | 50 | 26 |
| 12 | 0.4 | | 2.0 | 1.0 | 650 | 1.5 | 40 | 20 |

*the balance is Fe

After treatment the sulfur contained powder metallugy parts the surface layer contained $MoS_2$ it forms the $MoS_2$ on their surfaces, Cu diffuse to surface too. In all specimens the presence of molybdenum was detected right throw the thickness of the oxide layer. It concentration was a maximum near the surface (about 48%). Oxides have sealed the surface pores.

Thus, proposed method of thermochemical treatment provides formation of a dense alloyed oxide coating on the surface of powder metallurgy parts. Thickness of the coating may achieve 40 μm and above depending on the treatment conditions.

EXAMPLE 5

Investigation of different kind alloying chemical composition influence on oxidizing result was carried out in the industrial furnace. The oxidizing temperature was 460°+10°, soaking time are 1,2, and 3 hours. Parts made from 3 different materials: 1-low alloy steel (carbon 0.60, silicon –2%); 2-iron base sintered powder metallurgy Fe-100%; 3-sintered powder metallurgy (Fe-99%, graphite-1%) were delivered into furnace preheated to working temperature (460°±10° C.). The temperature reduced to 300° C.

After heating in waterless air atmosphere to 460° C. parts were subjected to the active atmospheres are forming from liquid media fed directly to the furnace retort.

Liquid media were saturated solutions of such water soluble chemical compounds as $(NH_4)_6Mo_7O_{24}.4H_2o$ (solution M1 ), $H_2MO_4$ (solution M2), $NH_4VO_3$(solution V1) and $V_2O_5$ (solution V2) in pure, distilled water.

After treatment at correspondent soaking time parts were took out from furnace and cooled on the air. The expirements results are given in Table 5.

TABLE 5

Results of thermochemical treatment in different active solutions.

| Solution type | Material type | Surface layer thickness (μm) after soaking time 1 hour | 2 hours | 3 hours |
|---|---|---|---|---|
| V1 | 1 | 9 | 22 | 45 |
| | 2 | 6 | 18 | 30 |
| | 3 | 12 | 24 | 45 |
| V2 | 1 | 4 | 15 | 32 |
| | 2 | 3 | 12 | 26 |
| | 3 | 4 | 20 | 41 |
| M1 | 1 | 12 | 25 | 48 |
| | 2 | 8 | 20 | 35 |
| | 3 | 15 | 30 | 51 |
| M2 | 1 | 5 | 12 | 40 |
| | 2 | 4 | 16 | 32 |
| | 3 | 6 | 27 | 43 |

The alloyed surface layers were uniform and had a gray colour with different tints.

Increasing in soaking time increase the thickness of surface layers. Both the carbon content in the alloys and presence of ammonia group in the water soluble alloying chemical composition have been used in these expirements positively influenced on the surface layers increasing.

The positive influence of carbon and ammonia on the thickness of alloying oxide surface layers was confirmed by expirements were explained in Example 6 too.

EXAMPLE 6

The expirements were carried out in the industrial shaft furnace with retort which diameter was 600 mm and length 600 mm. The parts produced from three kinds of plain carbon steels (No. 1-carbon content is 0.08%, No. 2-carbon content is 0.45%, and No. 3-carbon content is 0.7% and two kinds of sintered iron base alloys (No. 4-Fe 100%, N5-Graphite 1%, Fe-99%).

The processing temperature were 500°, 550°, 600° and 650° C., soaking time was 1.5 hours. The liquid medium was 2% of ammonia molybdate in distilled water. After this thermochemical processing on the details surfaces was formed a dense, uniform one or two phase oxide layer alloyed with molybdenum. It colours are light and dark gray. The phase composition is alloyed oxides like $Fe_3O_4$.

The influence of material chemical composition and processing temperature on the surface layers thickness (H) is represented in Table 6.

TABLE 6

Surface layers thickness in μm (H)

| No. | Processing Temperature °C. | Thickness, (H) in materials: 1 | 2 | 3 | 4 | 5 |
|---|---|---|---|---|---|---|
| 1 | 500 | 4 | 8 | 32 | 5 | 13 |
| 2 | 550 | 10 | 12 | 40 | 10 | 18 |
| 3 | 600 | 28 | 38 | 80 | 18 | 36 |
| 4 | 650 | 40 | 64 | 110 | 40 | 60 |

EXAMPLE 7

The experiments were carried out in the industrial conveyor agregate for continuous hardening and tempering of steel bolts and nuts. The tempering furnace had a special device for feeding of 2% water solutions of ammonium molybdate.

The objects of expirements were bolts M10×65 mm produced from plane carbon steel (carbon content 0.35%).

Regims of heat treatment were. Hardening: temperature of zone 1-850° C., zone 2-880° C., zone 3-850° C., whole treating time—35 min, quenching in water. Tempering: temperature of zone 1-510° C., zone 2-530° C., zone 3-530° C., zone 4-500° C., whole treating time—45 min. In zones 1, 3 and 4 fed the water solution of ammonium molybdate and its summ or velocity of feeidng was 2.25 liter/hr.

The thickness of oxide layers were about 15 μm. Directly after tempering bolts were quenched into 8% solution of water repellent GFJ into machine oil.

Atmospheric corrosion resistance properties of steel 35 (carbon content is 0.35%) bolts and nuts surfaces after different anticorrosive treatment were determined by using the special testing methods: drop, immersion and climate exposure.

The special solutions used to drop and immersion testing are as follows.

1. $CuSO_4$-20 grams per liter of water;
2. $CuSO_4$-82 grams, NaCl-33 grams, 0.1 N HCl-13 milliliter per liter of water.

The comparison of corrosion resistance of the steel surfaces have had molybdenum alloyed oxide layers was made with steel surfaces which were chemically or thermally oxidized. The test measured the time for the onset of rusting.

For the first solution it took 12–19 times longer to show rusting. The second solution it took 180–210 times longer to develop rusts.

The protection ability of the surface layers was also tested in a humidity chamber and compared with the protective ability to a Zn (7–15 μm thickness) coated part under the same conditions. The conditions of testing were: Temperature 40±2 degree C.; Relative humidity 95±3% with periodic condensation of moisture on the parts or samples in each day-cycle of testing and with upper limit of temperature of 55±2 degree C.

The corrosion resistance was estimated by measuring the number of cycles before the first sign of rusting appeared. It took 1.3–1.7 times longer for rusting to appear than it took for the Zn coated material.

EXAMPLE 8

The parts of steam and water pipe and boiler fittings and different kinds of hydraulic pumps are often out of action for reason of erosion and cavitation processes.

Durability of gray perlite cast-iron (carbon 3.5–3.6%, graphite 12–14%) after different finishing treatment was determined on special ultra sonic sound generator. The samples of cast-iron were in contact with water. The ultra sonic vibrations of water media create the erosion and cavitation damages of the testing surfaces. These damages were estimated by measuring of weight loss of testing samples (Table 7).

TABLE 7

| Type of finishing treatment | Weight loss (miligram) for testing time (hour) 1.0 | 2.0 | 3.0 |
|---|---|---|---|
| 1. Existing (Induction hardening, tempering 400 degree C. | 8.4 | 15.1 | 29.4 |
| 2. Treatment in media of dissociated 2% ammonium molybdate water solution | 2.7 | 5.3 | 9.2 |

The new method increases the erosion and cavitation resistance to 3.0–3.5 times.

The results were confirmed by testing the real parts in normal service for 4 years.

EXAMPLE 9

The mild steel (carbon content 0.1%) before enameling was submitted to the active steam atmosphere is contained the Mo, or V or W volatile oxides at temperatures 350° C. for a 60 minutes period. The active atmosphere were obtained from water solutions respectively $(NH_4)_6Mo_7O_{24}.4H_2O$, $NH_4VO_3$ and $H_2W_4O_{13}.gH_2O$ fed directly to the furnace retort where the mild steel parts were treated.

All alloyed oxide surface layer after this treatment had a very good adherence with basic metal surfaces, high wetting quality to enamels, and protection properties against hidrogen diffusion and saturation. As a result the enamel coating has no or has a few damages (scalings) of surface as shown in Table 8.

TABLE 8

| Substrate | Active Media | | | Treatment conditions temperature °C. | duration Minute | Defect products % |
|---|---|---|---|---|---|---|
| Mild steel | | Air | | 400 | 60 | 35 |
| Mild steel | | steam | | 450 | 60 | 25 |
| Mild steel | $MoO_3$ | and | Steam | 350 | 60 | 0.5 |
| Mild steel | $V_2O_5$ | and | Steam | 350 | 60 | 0 |
| Mild steel | $WO_3$ | and | Steam | 350 | 60 | 1.2 |

EXAMPLE 10

Investigation of sintered powder metallurgy sliding bearings anti-friction and anti-wear properties was carried out by accelerated wear tests on special friction machine type 270-SMT-1. Results of these tests are shown in Table 9.

Test Conditions: Unit pressure $P = 4$ MPa (40 kg/cm$^2$);

Speed of rotation $V = 1$ m/sec;

$$PV = 40 \frac{kg \cdot m}{cm^2 \cdot sec}$$

Friction pairs:

The shaft of diamter 35 mm, was made from iron-carbon steel (N carbon 0.45%). Hardness after hardening and tempering 40 Rockwell C. The porous sliding bearings had diameters 35/45 mm and height 10 mm, were made from different kinds of ferrous sintered powder metallurgy products. These parts were tested without (A) or with coating (B). A-serial vacuum impregnation of spindle (machine) oil. B-treatment into active atmosphere which was obtained by thermal dissociation of 2% ammonium molybdate solution in distilled water. This liquid medium fed directly into furnace retort where sliding bearings have been oxidizing. Processing temperature was 600° C., soaking time 60 min, cooling directly from furnace into machine oil.

TABLE 9

| Number of test | Composition of sliding bearings* G % | S % | Cu % | Fe % | Coefficient of friction Varient of treatment A | B | Specific intensity of bearing wear g/kilometer, cm$^2$ Varient of treatment A | B | Specific intensity of shaft wear g/kilometer, cm$^2$ Varient of treatment A | B | Path of friction before of setting kilometer Varient of treatment A | B | Temperature of setting °C. Varient of treatment A | B |
|---|---|---|---|---|---|---|---|---|---|---|---|---|---|---|
| 1 | 5 | 3 | 3 | 89 | 0.095 | 0.046 | 0.4795 | 0.4038 | 0.0267 | 0.0064 | 0.227 | 0.703 | 174 | 205 |
| 2 | 1 | 3 | 3 | 93 | 0.075 | 0.049 | 0.5715 | 0.2362 | 0.0267 | 0.0022 | 0.300 | 0.825 | 193 | 391 |
| 3 | 5 | 1 | 3 | 91 | 0.055 | 0.047 | 0.6008 | 0.1927 | 0.0776 | 0.0222 | 0.395 | 0.725 | 175 | 254 |
| 4 | 1 | 1 | 3 | 95 | 0.057 | 0.047 | 0.7206 | 0.2538 | 0.0460 | 0.0161 | 0.318 | 0.474 | 146 | 352 |
| 5 | 5 | 3 | 1 | 91 | 0.077 | 0.045 | 0.8011 | 0.2500 | 0.1880 | 0.0461 | 0.130 | 0.405 | 102 | 297 |
| 6 | 1 | 3 | 1 | 95 | 0.080 | 0.053 | 1.1934 | 0.2750 | 0.1520 | 0.0104 | 0.153 | 0.537 | 116 | 341 |
| 7 | 5 | 5 | 1 | 93 | 0.065 | 0.043 | 0.4208 | 0.1312 | 0.1970 | 0.0223 | 0.148 | 0.185 | 118 | 246 |
| 8 | 1 | 1 | 1 | 97 | 0.067 | 0.055 | 1.0095 | 0.2500 | 0.0590 | 0.0057 | 0.174 | 0.255 | 138 | 269 |
| 9 | 3 | 2 | 2 | 93 | 0.058 | 0.032 | 1.3999 | 0.1381 | 0.1666 | 0.0220 | 0.243 | 0.895 | 124 | 180 |
| Arithmetic mean values | | | | | 0.0698 | 0.0463 | 0.7996 | 0.2367 | 1.0440 | 0.1704 | 0.221 | 0.556 | 142.8 | 281.6 |
| Results | | | | | | Less in 1.52 times | | less in 3.83 times | | less in 6.12 times | | more in 2.51 times | | more in 1.97 times |

*G is graphite Fe is iron
*S is sulphur
*Cu is cooper

EXAMPLE 11

The speciments of cast-iron diesel and carburetted engines compression and oil piston rings which chemical composition is represented in Table 10 were treated in the shaft electric furnace. The oxidizing alloying atmosphere was obtained from 2% aqueous solution of ammonium molybdate fed directly to the furnace retort. The speciments were placed in the furnace preheated to the working temperature which were 500°, 550°, 600° and 650° C. Soaking time were 1 and 2 hours. After treatment specimens were cooled in the industrial oil. The influence of treatment parameters on the oxide surface thickness can be seen in Table 11. The oxide layer surface microhardness ($H_{100g}$) was increased by formation alloying oxides from 325–360 to 519–537 and even 619. The core hardness, piston ring gap and elasticity remained unchanged at 500°, 550° and 600° C'.

TABLE 10

Chemical composition of cast-iron piston rings of diesel and carburetted engines.

| Chemical | Content of elements in rings | | | |
|---|---|---|---|---|
| | Compression | | Oil | |
| element | Diesel | carburetted | diesel | carburetted |
| C | 3.4–3.7 | 3.4–3.9 | 3.4–3.7 | 3.4–3.9 |
| Si | 2.4–2.9 | 2.2–3.0 | 2.4–2.9 | 2.2–3.0 |
| Mn | 0.5–0.8 | 0.4–0.9 | 0.5–0.8 | 0.4–0.9 |
| P | 0.3–0.5 | 0.2–0.7 | 0.3–0.55 | 0.2–0.7 |
| S | <0.05 | <0.1 | <0.05 | <0.01 |
| Cr | 0.2–0.5 | 0.1–0.35 | 0.2–0.5 | 0.1–0.35 |
| Ni | | 0.08–0.25 | | 0.08–0.25 |
| Cu | 0.4–0.6 | 0.25–0.65 | 0.4–0.6 | 0.25–0.65 |
| Ti | | 0.04–0.15 | | 0.04–0.15 |
| Mo | | 0.3–0.65 | | 0.1–0.6 |
| V | 0.05–0.25 | 0.05–0.30 | 0.05–0.25 | 0.05–0.30 |
| Rare-earth elements | 0.007–0.01 | | 0.007–0.01 | |
| B | 0.01–0.03 | | 0.01–0.03 | |
| Al | 0.006–0.01 | | 0.006–0.01 | |
| N | 0.005–0.01 | | 0.005–0.01 | |

TABLE 11

Oxidizing parameters influence on the thickness of oxide surface layers

| | Thickness of oxide surface layer, μm | | |
|---|---|---|---|
| | Process | Soaking time, hr | |
| No. | temperature, °C. | 1 | 2 |
| 1 | 500 | 7 | 25 |
| 2 | 550 | 10 | 34 |
| 3 | 600 | 16 | 48 |
| 4 | 650 | 20 | 60 |

It will be understood that each of the elements described above, or two or more together, may also find a useful application in other types of methods differing from the types described above.

While the invention has been illustrated and described as embodied in a method of producing oxide surface layers on metals and alloys, it is not intended to be limited to the details shown, since various modifications and structural changes may be made without departing in any way from the spirit from the present invention.

Without further analysis, the foregoing will so fully reveal the gist of the present invention that others can, by applying current knowledge readily adapt it for various applciations without omitting features that, from the standpoint of prior art, fairly constitute essential characteristics of the generic or specific aspects of this invention.

What is claimed as new and desired to be protected by Letters Patent is set forth in the appended claims:

1. A method of producing oxide surface layers on metals and alloys, comprising the steps of delivering a metal or alloy into a working chamber preheated to temperature from 200° C. to below its melting point so that the metal or alloy is heated in the working chamber to a temperature from 100° C. to below a melting point of the metal or alloy in waterless atmosphere; and introducing into the working chamber a water solution of substances which contain alloying elements so that water steam and volatile oxides of the alloying elements are formed directly into the working chamber and interact with a surface of the metal or alloy to produce an alloyed surface layer of the metal or alloy.

2. A method as defined in claim 1, wherein the metal or alloy is a metal or alloy containing at least one metal element selected from the group consisting of Fe, Mn, Si, Co, Ni, Cu, Al, Ti, Zr, Hf, V, Ta, Cr, Mo, W, Be, Mg, Y and B.

3. A method as defined in claim 1, wherein the alloying element is an element located in the groups of Mendeleevin periodic table selected from the group Ia, IIa, IIIa, IVa, Va, IIIb, IVb, Vb, and VIb.

4. A method as defined in claim 1 wherein the alloying element is an element selected from the group consisting of Li, Be, B, Ge, N, Y, Ti, V, Cr, Mo, and W.

5. A method as defined in claim 1, wherein the substance is an inorganic water soluable chemical compound of alloying elements without nitrogen group; and further comprising the step of feeding into the working chamber gaseous $NH_3$ in amount of 3–25% of a working chamber volume per hour.

6. A method as defined in claim 1, wherein the substance is an inorganic water soluable chemical compound without nitrogen group; and further comprising mixing 25% of aquatic $NH_3$ with the water solution of an alloying element for feeding directly into the working chamber.

7. A method as defined in claim 1; and further comprising the step of cooling of the metal or alloy with the obtained oxide surface layer.

8. A method as defined in claim 1; and further comprising the step of selecting time of contact between the alloy and the water solution such that element contained in the alloy diffuse into a surface of the alloy and react with the alloying elements.

9. A method as defined in claim 7, wherein said cooling is performed subsequently in the working chamber which has been cooled after the production of the alloyed surface layer, and thereafter outside of the working chamber.

10. A method as defined in claim 7, wherein said cooling is performed in a solid medium selected from the group consisting of sand, oxide, carbide, nitride and boride.

* * * * *